US005212498A

United States Patent [19]

Sugimori

[11] Patent Number: 5,212,498

[45] Date of Patent: May 18, 1993

[54] JET RECORDING APPARATUS WITH MEANS FOR CONTROLLING POWER TO FIXING HEATERS ACCORDING TO THE NUMBER OF PRINTED DOTS IN REGIONS CORRESPONDING TO EACH HEATER

[75] Inventor: Masao Sugimori, Hirakata, Japan

[73] Assignee: Mita Industrial Co., Ltd., Japan

[21] Appl. No.: 780,785

[22] Filed: Oct. 23, 1991

[30] Foreign Application Priority Data

Nov. 1, 1990 [JP] Japan ..... 2-297546

[51] Int. Cl.[5] ..... B41J 2/01

[52] U.S. Cl. ..... 346/25; 219/216; 101/424.1; 346/140 R

[58] Field of Search ..... 346/25, 140 R; 219/216; 101/424.1, 488

[56] References Cited

U.S. PATENT DOCUMENTS 4,469,026 9/1984 Irwin ..... 346/25 X

OTHER PUBLICATIONS

Ayash et al; Ink Jet Dryer with Individually Actuable Elements; Xerox Disclosure Journal, V7, N5, Sep./Oct. 1982, pp. 317-318.

*Primary Examiner*—Joseph W. Hartary

*Attorney, Agent, or Firm*—Beveridge, DeGrandi, Weilacher

[57] ABSTRACT

A plurality of fixing heaters for heating recording paper after printing to speed up drying of ink are disposed side by side in a direction at right angles to the direction in which recording paper is fed. The total number of printed dots by region corresponding to each of the fixing heaters is stored for every one or a plurality of lines of the recording paper. Each of the fixing heaters is driven by power proportional to the total number of printed dots in a corresponding region on the basis of the total number of printed dots by region corresponding to each of the fixing heaters for one or a plurality of lines of the recording paper which is in a position to be heated by the fixing heaters. According to the present invention, even when the printing density in the line direction varies, an inkjet recording apparatus is obtained in which no unfixed portion of ink occurs and the driving efficiency of the fixing heaters is high.

5 Claims, 3 Drawing Sheets

JET RECORDING APPARATUS WITH MEANS FOR CONTROLLING POWER TO FIXING HEATERS ACCORDING TO THE NUMBER OF PRINTED DOTS IN REGIONS CORRESPONDING TO EACH HEATER

BACKGROUND OF THE INVENTION

1. Field of the Invention

The present invention relates to inkjet recording apparatuses.

2. Description of the Prior Art

As to inkjet recording apparatuses, one has been already developed which is provided with a fixing heater for heating recording paper after recording to speed up drying of ink. In addition, one has been already developed in which a fixing heater is driven at high temperatures because large amounts of ink must be dried when printing is done at high density, while being driven at low temperatures so as to economize power consumption when printing is done at low density (see Japanese Patent Laid-Open Gazette No. 113249/1989).

The above described conventional inkjet recording apparatus controls the heating temperature of the fixing heater for each line. Accordingly, it has the disadvantages in that an unfixed portion of ink occurs and the driving efficiency of the fixing heater is not high. when the printing density in the line direction varies.

SUMMARY OF THE INVENTION

An object of the present invention is to provide an inkjet recording apparatus in which no unfixed portion of ink occurs and the driving efficiency of fixing heaters is high even when the printing density in the line direction varies.

A first inkjet recording apparatus according to the present invention is characterized by comprising a plurality of fixing heaters disposed side by side in a direction at right angles to the direction in which recording paper is fed and for heating recording paper after printing to speed up drying of ink, means for storing the total number of printed dots by region corresponding to each of the above fixing heaters for every one or a plurality of lines of the recording paper, and means for driving each of the above fixing heaters by power proportional to the total number of printed dots in a corresponding region on the basis of the above total number of printed dots by region corresponding to each of the fixing heaters for one or a plurality of lines of the recording paper which is in a position to be heated by the above fixing heaters.

In the first inkjet recording apparatus according to the present invention, a plurality of fixing heaters for heating recording paper after printing to speed up drying of ink are disposed side by side in a direction at right angles to the direction in which recording paper is fed. The total number of printed dots by region corresponding to each of the fixing heaters is stored for every one or a plurality of lines of the recording paper. Each of the fixing heaters is driven by power proportional to the total number of printed dots in a corresponding region on the basis of the total number of printed dots by region corresponding to each of the fixing heaters for one or a plurality of lines of the recording paper which is in a position to be heated by the fixing heaters.

In the first inkjet recording apparatus according to the present invention, even when the printing density in the line direction varies, no unfixed portion of ink occurs and the driving efficiency of the fixing heaters is high.

A second inkjet recording apparatus according to the present invention comprises an inkjet type print heat for doing printing on recording paper, a plurality of fixing heaters disposed side by side in a direction at right angles to the direction in which recording paper is fed in a position to be heated one line of the recording paper ahead of a position to be printed by the above print head in the direction in which recording paper is fed and for heating the recording paper after printing to speed up drying of ink, a recording paper conveying device for conveying the recording paper, paper feeding control means for intermittently feeding the recording paper one line at a time by the above recording paper conveying device, first storing means for subjecting image data to dot map development for each line of the recording paper, second storing means for storing the total number of printed dots by region corresponding to each of the above fixing heaters for each line of the recording paper on the basis of the contents stored in the above first storing means, printing control means for doing printing corresponding to one line on the recording paper by the above print head on the basis of the contents stored in the above first storing means, and heater control means for driving each of the above fixing heaters by power proportional to the total number of printed dots in a corresponding region on the basis of the total number of printed dots by region corresponding to each of the fixing heaters for one line, on which printing is done the last time, of the recording paper which is stored in the above second storing means when the recording paper is fed by one line by the above paper feeding control means after the printing corresponding to one line is done. The above described image data is fed from, for example, a host computer.

The second inkjet recording apparatus according to the present invention comprises an inkjet type print head for doing printing on recording paper, a plurality of fixing heaters disposed side by side in a direction at right angles to the direction in which recording paper is fed in a position to be heated one line of the recording paper ahead of a position to be printed by the above print head in the direction in which recording paper is fed and for heating the recording paper after printing to speed up drying of ink, and a recording paper conveying device for conveying the recording paper, the recording paper being intermittently fed one line at a time by the above recording paper conveying device.

The image data is subjected to dot map development in the first storing means for each line of the recording paper. The total number of printed dots by region corresponding to each of the fixing heaters is stored in the second storing means for each line of the recording paper on the basis of the contents stored in the above first storing means. Printing corresponding to one line is done on the recording paper by the above print head on the basis of the contents stored in the above first storing means.

When the recording paper is fed by one line by the above paper feeding control means after the printing corresponding to one line is done, each of the above fixing heaters is driven by power proportional to the total number of printed dots in a corresponding region on the basis of the total number of printed dots by region corresponding to each of the fixing heaters for one line, on which printing is done the last time, of the recording paper which is stored in the above second storing means.

In the second inkjet recording apparatus according to the present invention, even when the printing density in the line direction varies, no unfixed portion of ink occurs and the driving efficiency of the fixing heaters is high.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Description is now made of an embodiment of the present invention with reference to the drawings.

Figure 1:
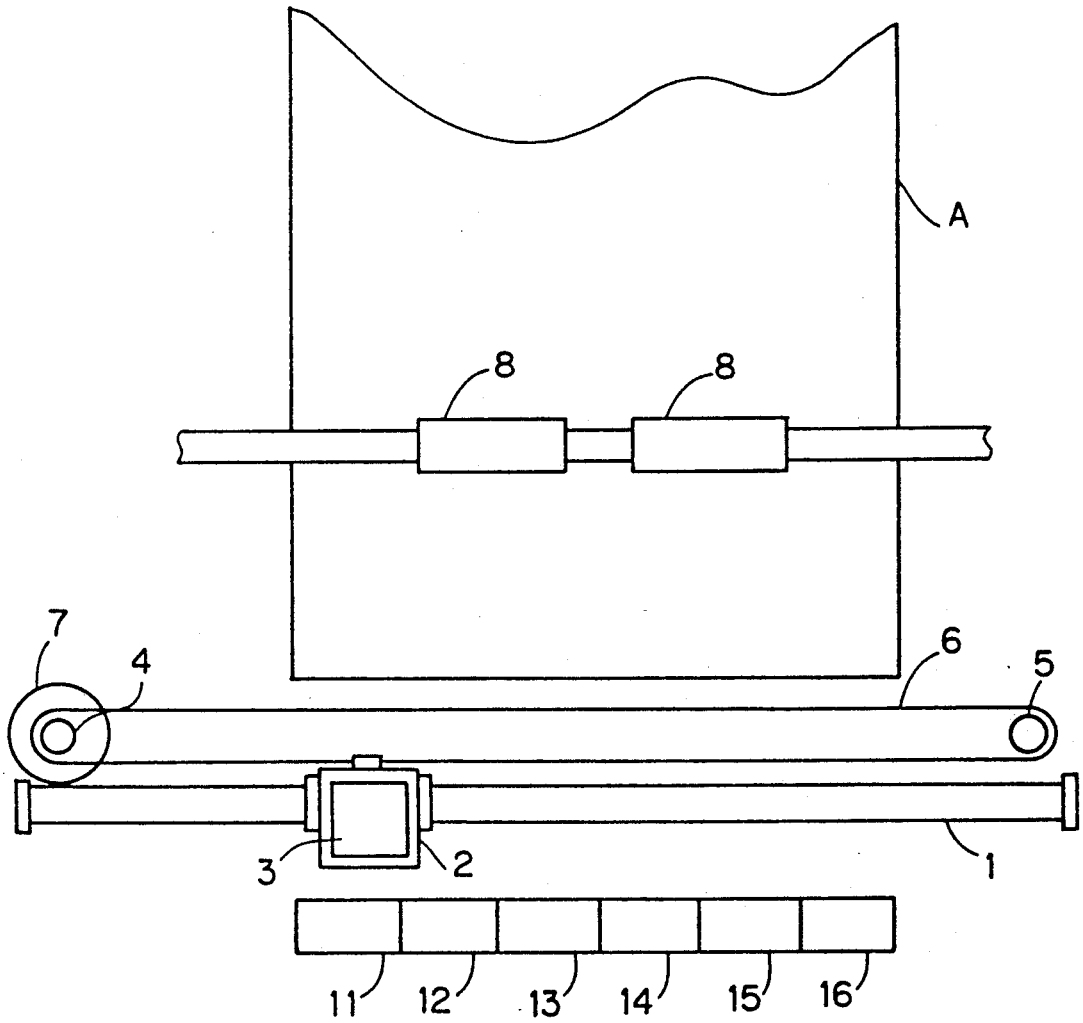
FIG. 1 is a plan view showing a recording portion of an inkjet recording apparatus.

FIG. 1 shows the appearance as viewed from the plane surface of a recording portion of an inkjet recording apparatus. In the following description, "left", "right", "front", and "rear" respectively mean the left side, the right side, the lower side, and the upper side of FIG. 1.

A carriage 2 is movably mounted on a carriage rail 1 extending in a direction at right angles to the direction in which recording paper is fed. A print head 3 is mounted on the carriage 2 such that the surface from which ink is discharged is directed downward.

An endless carriage driving belt 6 stretched between a pair of right and left pulleys 4 and 5 is disposed at the rear of the carriage rail 1. The carriage driving belt 6 travels to and fro by a carriage motor 7 for rotating one of the pulleys 4. The carriage 2 is connected to the carriage driving belt 6, so that the carriage 2 moves to and fro by the travel of the carriage driving belt 6.

Paper feeding rollers 8 for conveying recording paper A to a position to be printed are disposed at the rear of the carriage driving belt 6. The paper feeding rollers 8 are driven by a paper feeding motor 9 which is not shown in FIG. 1 (see FIG. 2).

A plurality of fixing heaters 11 to 16 for drying ink on the recording paper A after printing are disposed side by side in the direction at right angles to the direction in which recording paper is fed ahead of the carriage rail 1. In this example, six fixing heaters 11 to 16 are provided.

The recording paper A is conveyed to a position to be printed below the carriage rail 1 by the paper feeding rollers 8. In the position to be printed, printing corresponding to one line is done on the recording paper A by the print head 3. When the printing corresponding to one line is terminated, the recording paper A is conveyed one line ahead of the position, where printing corresponding to the next line is done. Thus, printing is done on the recording paper A for each line.

On the other hand, when a line, on which printing is done, of the recording paper A leads to a position directly over the fixing heaters 11 to 16, each of the fixing heaters 11 to 16 is so driven that it reaches a heating temperature corresponding to the printing density in the line direction as described later, thereby to dry the ink on the recording paper A.

Figure 2:
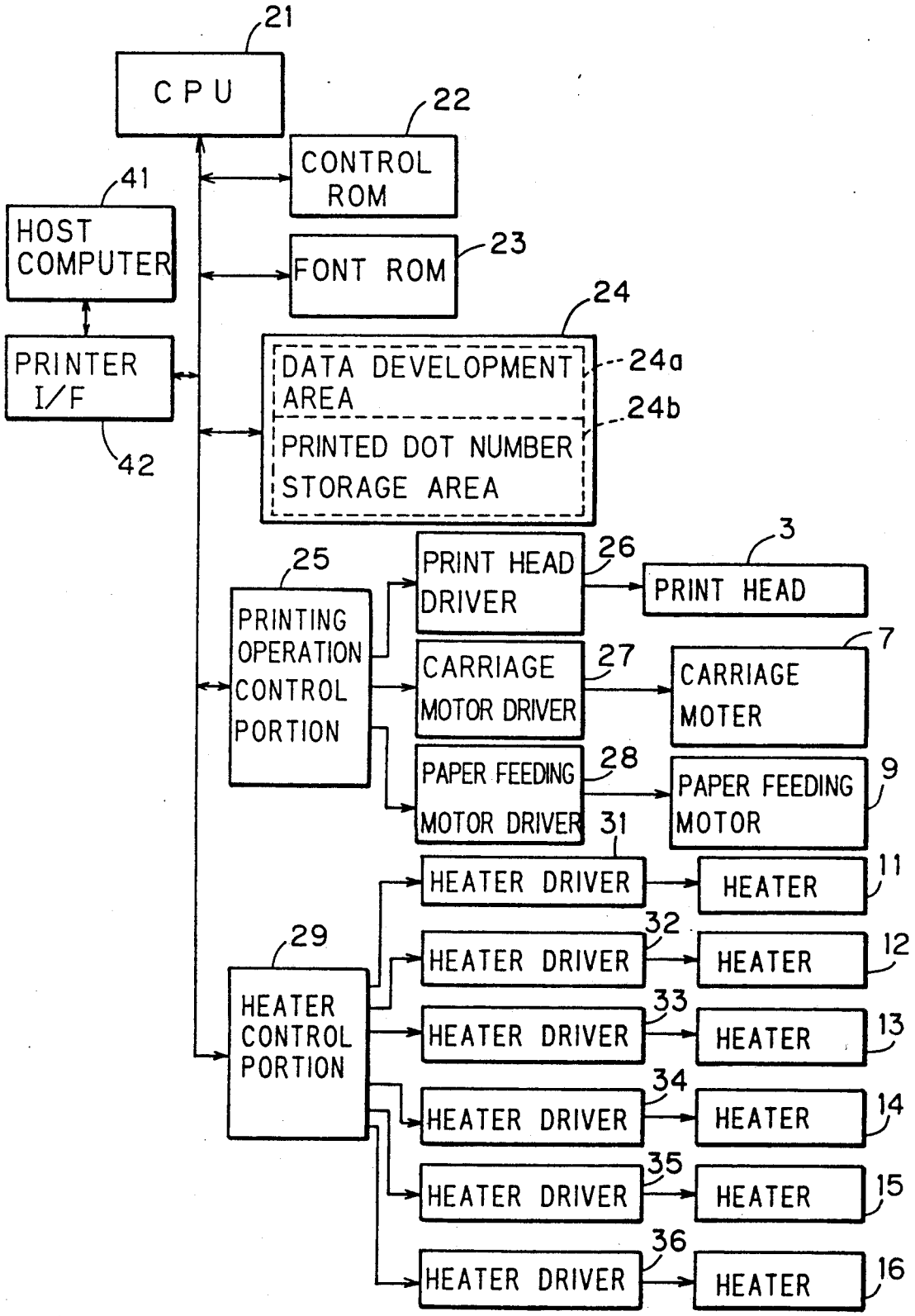
FIG. 2 is a block diagram showing the electrical construction of the inkjet recording apparatus.

FIG. 2 shows the electrical construction of an inkjet recording apparatus.

Image data is sent to the inkjet recording apparatus from a host computer 41 through a printer interface 42.

The inkjet recording apparatus is controlled by a CPU 21. The CPU 21 comprises a control ROM 22 for storing its program and the like, a font ROM 23 for storing a font and the like, and a RAM for storing necessary data. The RAM 24 includes a dot map data development area **24*a* in which image data sent from the host computer 41 is subjected to dot map development and a printed dot number storage area 24*b* in which the total number of printed dots in a region corresponding to each of the fixing heaters 11 to 16** on one line is stored for each region.

A print head control signal is sent to a driving circuit of the print head 3 (print head driver 26) from the CPU 21 through a printing operation control portion 25. In addition, a carriage motor control signal is sent to a driving circuit of the carriage motor 7 (carriage motor driver 27) from the CPU 21 through the printing operation control portion 25. Furthermore, a paper feeding motor control signal is sent to a driving circuit of the paper feeding motor 9 (paper feeding motor driver 28) from the CPU 21 through the printing operation control portion 25.

Furthermore, a heater control signal for controlling each of the fixing heaters 11 to 16 is sent to driving circuits of the fixing heaters 11 to 16 (heater drivers 31 to 36) from the CPU 21 through a heater control portion 29.

Figure 3:
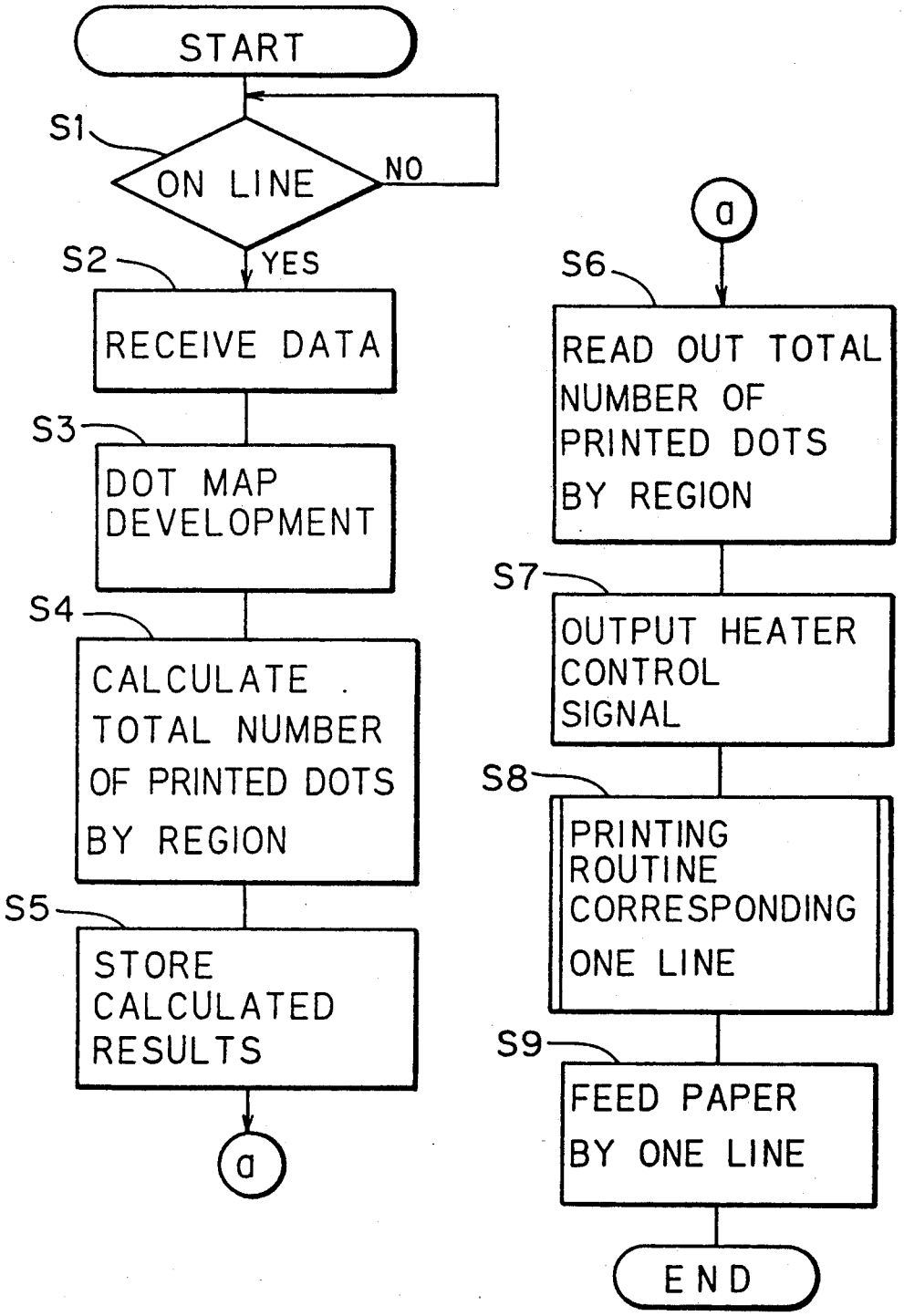
FIG. 3 is a flow chart showing the procedure for processing by a CPU.

FIG. 3 shows the procedure for processing corresponding to one line by the CPU 21.

When the inkjet recording apparatus is connected to the host computer 41 (step S1) and data is received from the host computer 41 (step S2), image data corresponding to one line is subjected to dot map development in the dot map data development area **24*a* in the RAM 24** (step S3).

The total number of printed dots by region corresponding to each of the fixing heaters 11 to 16 is then calculated on the basis of the data developed in the dot map data development area **24*a* (step S4). The calculated total number of printed dots by region corresponding to each of the fixing heaters is stored in the printed dot number storage area 24*b* in the RAM 24** for each region (step S5).

Then, the total number of printed dots by region corresponding to each of the fixing heaters for a line currently positioned directly over the fixing heaters 11 to 16 on the recording paper A is read out from the printed dot number storage area **24*b* in the RAM 24 (step S6), and a heater control signal proportional to the total number of printed dots by region corresponding to each of the fixing heaters is sent to the heater drivers 31 to 36 through the heater control portion 29 (step S7). Consequently, each of the fixing heaters 11 to 16** is driven by power proportional to the total number of printed dots in a corresponding region.

Consequently, a region corresponding to each of the fixing heaters in the line direction of the recording paper A is heated at a temperature corresponding to the printing density in the region. As a result, even when the printing density in the line direction of the recording paper A varies, the occurrence of an unfixed portion of the ink can be prevented and the driving efficiency of the fixing heaters 11 to 16 is increased.

Thereafter, a printing routine corresponding to one line is implemented, so that printing corresponding to one line is done on the recording paper A (step S8).

After the recording paper A is fed by one line (step S9), the program is returned to the step S1, to repeat processing for the next line.

Although in the above described embodiment, six fixing heaters are provided, the number of fixing heaters can be an arbitrary number not less than two.

Additionally, the total number of printed dots by region corresponding to each of the fixing heaters 11 to 16 may be calculated and stored for a plurality of lines, to drive each of the fixing heaters 11 to 16 by power proportional to the total number of printed dots in a corresponding region on the basis of the total number of printed dots by region corresponding to each of the fixing heaters for the plurality of lines of the recording paper A which is in a position to be heated by the fixing heaters 11 to 16.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An inkjet recording apparatus including an inkjet print head for printing on recording paper, recording paper conveying means, and paper feeding control means for controlling paper feeding by said recording paper conveying means, said apparatus comprising:

a plurality of fixing heaters, disposed side by side in a direction at right angles to the direction in which recording paper is fed, for heating recording paper after printing to speed up drying of ink;

means for storing a total number of printed dots by region for at least one line of the recording paper, each of said fixing heaters having a corresponding region; and means for driving each of said fixing heaters by power proportional to the total number of printed dots in its corresponding region for said at least one line of the recording paper which is in a position to be heated by said fixing heaters.

2. An inkjet recording apparatus comprising:

an inkjet type print head for printing on recording paper;

a plurality of fixing heaters disposed side by side in a direction at right angles to the direction in which recording paper is fed, in positions to heat one line of the recording paper ahead of a printing position of said print head in the direction in which recording paper is fed;

a recording paper conveying device for conveying the recording paper;

paper feeding control means for intermittently feeding the recording paper one line at a time by said recording paper conveying device;

first storing means for subjecting image data to dot map development for each line of the recording paper;

second storing means for storing the total number of printed dots by region for each line of the recording paper on the basis of the contents stored in said first storing means, each fixing heater having a corresponding region;

printing control means for controlling printing corresponding to one line on the recording paper by said print head on the basis of the contents stored in said first storing means; and heater control means for driving each of said fixing heaters by power which is proportional to a total number of printed dots in each corresponding region on the basis of the total number of printed dots in each region in one line on which printing has been done, each total number of printed dots being stored in said second storing means when the recording paper is fed by one line by said paper feeding control means after printing corresponding to one line has been done.

3. The inkjet recording apparatus according to claim 2, wherein said image data is supplied from a host computer.

4. An inkjet recording apparatus comprising:

an inkjet type print head for printing on recording paper;

a plurality of fixing heaters disposed side by side along a direction at a right angle to the direction in which recording paper is fed, in positions to heat one line of recording paper printing by said print head;

a recording paper conveying device for conveying the recording paper;

paper feeding control means for intermittently feeding the recording paper one line at a time by said recording paper conveying device;

first storing means for subjecting image data to dot map development for each line of the recording paper;

second storing means for storing the total number of printed dots in a region which corresponds to at least one of said fixing heaters for each line of the recording paper on the basis of the contents stored in said first storing means;

printing control means for controlling printing on the recording paper by said print head on the basis of the contents stored in said first storing means; and heater control means for driving said at least one of said fixing heaters by applying power to said at least one heater in proportion to the total number of printed dots in said region, said total number of printed dots being stored in said second storing means when the recording paper is fed by one line by said paper feeding control means after said one line has been printed.

5. The inkjet recording apparatus according to claim 4, wherein said image data is supplied from a host computer.

* * * * *